US008698733B2

(12) United States Patent
Hong et al.

(10) Patent No.: US 8,698,733 B2
(45) Date of Patent: Apr. 15, 2014

(54) ELECTROPHORETIC DISPLAY AND METHOD FOR DRIVING THE SAME

(75) Inventors: Sung-Jin Hong, Seoul (KR); Il-Pyung Lee, Suwon-si (KR); Jae-Byung Park, Seongnam-si (KR); Yong-Woo Lee, Seoul (KR); Sung-Hoon Yang, Yongin-si (KR)

(73) Assignee: Samsung Display Co., Ltd. (KR)

( * ) Notice: Subject to any disclaimer, the term of this patent is extended or adjusted under 35 U.S.C. 154(b) by 1042 days.

(21) Appl. No.: 12/157,139

(22) Filed: Jun. 6, 2008

(65) Prior Publication Data

US 2009/0066635 A1 Mar. 12, 2009

(30) Foreign Application Priority Data

Sep. 6, 2007 (KR) ..... 10-2007-0090530

(51) Int. Cl.

| | |
|---|---|
| ***G09G 3/30*** | (2006.01) |
| ***G09G 5/00*** | (2006.01) |
| ***G06T 15/50*** | (2011.01) |
| ***G06T 15/00*** | (2011.01) |
| ***G09G 5/10*** | (2006.01) |
| ***G09G 5/02*** | (2006.01) |
| ***G02B 26/00*** | (2006.01) |

(52) U.S. Cl.

USPC ..... 345/107; 345/79; 345/82; 345/204; 345/426; 345/428; 345/691; 345/694; 359/296

(58) Field of Classification Search

USPC ..... 345/107

See application file for complete search history.

(56) References Cited

U.S. PATENT DOCUMENTS 6,639,580 B1 10/2003 Kishi et al.
6,822,783 B2 * 11/2004 Matsuda et al. ..... 359/296

(Continued)

FOREIGN PATENT DOCUMENTS

JP 2003-5225 1/2003

(Continued)

OTHER PUBLICATIONS

Patent Abstracts of Japan, Publication No. 2003-005225, Jan. 8, 2003, 1 p.

(Continued)

*Primary Examiner* — Sumati Lefkowitz
*Assistant Examiner* — Andrew Yeretsky
(74) *Attorney, Agent, or Firm* — Innovation Counsel LLP

(57) ABSTRACT

Disclosed is an electrophoretic display and a method for driving the electrophoretic display. The method for driving the electrophoretic display, which includes a first electrode, a second electrode, and an electrophoretic layer including electrophoretic particles disposed in a plurality of pixels receiving the voltage for driving from the first electrode and the second electrode and provided between the first electrode and the second electrode includes applying a reset voltage to the pixels, applying a reset compensation voltage including reversed polarity to the reset voltage to the pixels, applying an image display voltage including the same or different polarity during a predetermined time between the neighboring pixels, and applying an image display compensation voltage including reversed polarity to the image display voltage to the pixels during a predetermined time. The foregoing method provides a potential distribution which is symmetrical in the boundary region between the neighboring pixels such that the display size of the real image of each of the pixels is uniform and an afterimage may be prevented, thereby improving the display performance.

13 Claims, 10 Drawing Sheets

(56) References Cited

U.S. PATENT DOCUMENTS

| | | | | |
|---|---|---|---|---|
| 2005/0024353 | A1* | 2/2005 | Amundson et al. | 345/204 |
| 2005/0280626 | A1* | 12/2005 | Amundson et al. | 345/107 |
| 2006/0202948 | A1* | 9/2006 | Johnson et al. | 345/107 |
| 2006/0262080 | A1 | 11/2006 | Matsuda | |
| 2007/0080927 | A1 | 4/2007 | Zhou et al. | |
| 2007/0091117 | A1 | 4/2007 | Zhou et al. | |
| 2008/0204399 | A1* | 8/2008 | Choi et al. | 345/107 |

FOREIGN PATENT DOCUMENTS

| | | |
|---|---|---|
| JP | 2003-5229 | 1/2003 |
| JP | 2004-102055 | 4/2004 |
| JP | 2005-31264 | 2/2005 |
| JP | 2005-37966 | 2/2005 |
| JP | 2005-215092 | 8/2005 |
| JP | 2006-23757 | 1/2006 |
| JP | 2006-162969 | 6/2006 |
| JP | 2007-17969 | 1/2007 |
| KR | 2006-0120135 | 11/2006 |
| KR | 2007-0016108 | 2/2007 |

OTHER PUBLICATIONS

Patent Abstracts of Japan, Publication No. 2003-005229, Jan. 8, 2003, 1 p.
Patent Abstracts of Japan, Publication No. 2004-102055, Apr. 2, 2004, 1 p.
Patent Abstracts of Japan, Publication No. 2005-031264, Feb. 3, 2005, 1 p.
Patent Abstracts of Japan, Publication No. 2005-037966, Feb. 10, 2005, 1 p.
Patent Abstracts of Japan, Publication No. 2005-215092, Aug. 11, 2005, 1 p.
Patent Abstracts of Japan, Publication No. 2006-023757, Jan. 26, 2006, 1 p.
Patent Abstracts of Japan, Publication No. 2006-162969, Jun. 22, 2006, 1 p.
Patent Abstracts of Japan, Publication No. 2007-017969, Jan. 25, 2007, 1 p.
Korean Patent Abstracts, Publication No. 1020060120135, Nov. 24, 2006, 1 p.
Korean Patent Abstracts, Publication No. 1020070016108, Feb. 7, 2007, 1 p.

* cited by examiner

ELECTROPHORETIC DISPLAY AND METHOD FOR DRIVING THE SAME

CROSS-REFERENCE TO RELATED APPLICATION

This application claims priority to and the benefit of Korean Patent Application No. 10-2007-0090530 filed in the Korean Intellectual Property Office on Sep. 6, 2007, the entire contents of which are incorporated herein by reference.

BACKGROUND OF THE INVENTION (a) Field of the Invention

The present invention relates to a method for driving an electrophoretic display. More particularly, the present invention relates to a method for driving an electrophoretic display to provide the display of uniform images in each pixel in the electrophoretic display.

(b) Description of the Related Art

Recently, flat panel displays including an electrophoretic display (EPD) and a liquid crystal display (LCD) have been developed as substitutes for a cathode ray tube (CRT) display.

The electrophoretic display includes a thin film transistor array panel having a plurality of pixel electrodes, a common electrode panel having a common electrode, and an electrophoretic layer disposed between the two panels. The electrophoretic layer includes an electrophoretic member having a plurality of micro capsules and a maintaining resin for maintaining the electrophoretic member to the two panels. Each micro capsule includes electrophoretic particles that have positive or negative charges and move between the pixel electrodes and the common electrode, and a dielectric fluid in which the electrophoretic particles are dispersed.

In the driving process of the electrophoretic display, a common voltage as a reference voltage is applied to the common electrode and data voltages that are larger or smaller than the common voltage are applied to the pixel electrodes such that the electrophoretic particles disposed in each pixel are applied with the driving voltages of positive or negative charge corresponding to the differences between the common voltage and the data voltages. When applying the driving voltages, the electrophoretic particles that have positive or negative charges move between the pixel electrodes and the common electrode. The movements of the electrophoretic particles are finished when the desired images are displayed in the corresponding pixels, and then the corresponding pixels do not receive additional driving voltages until requirement of movement of the electrophoretic particles to display different images.

However, since the degree of movement of the electrophoretic particles is controlled by the application times of the driving voltages, the application times of the driving voltages are different for each pixel so as to display various images in each pixel. Accordingly, when the driving voltage is applied to a predetermined pixel but the driving voltage is not applied to a neighboring different pixel with reference to an arbitrary time, the electrophoretic particles disposed on the boundary of the two pixels receive the influence of the driving voltage applied to the predetermined pixel such that the electrophoretic particles disposed on the boundary move like the electrophoretic particles disposed in the predetermined pixel. Accordingly, the size of the image displayed in the predetermined pixel is increased compared with the neighboring different pixel. Accordingly, the entire display size between neighboring pixels becomes non-uniform.

Further, if the image display voltages are repeatedly applied to the electrophoretic particles to display images of various grays with time, arbitrary charges are stimulated in the two electrodes such that afterimages may be generated, thereby deteriorating display performance.

The above information disclosed in this Background section is only for enhancement of understanding of the background of the invention and therefore it may contain information that does not form the prior art that is already known in this country to a person of ordinary skill in the art.

SUMMARY OF THE INVENTION

According to the present invention a method is provided for driving an electrophoretic display that can improve image display performance by symmetrically forming a potential distribution in the boundaries between neighboring pixels, thereby preventing an afterimage and forming a uniform size of the real image.

The present invention is not limited by the above feature, and other advantages that are not mentioned may be comprehended in detail from the following description by a person of an ordinary skill in the art.

A method for driving an electrophoretic display including a first electrode, a second electrode, and an electrophoretic layer including electrophoretic particles disposed in a plurality of pixels receiving a driving voltage from the first and second electrodes and provided between the first and second electrodes according to the present invention includes applying a reset voltage to the pixels, applying a reset compensation voltage having reversed polarity to the reset voltage to the pixels, applying image display voltages having the same or different polarities during a predetermined time between neighboring pixels, and applying image display compensation voltages having the reversed polarity to the image display voltages to the pixels during a predetermined time.

A potential distribution having symmetry with respect to the neighboring pixels may be formed by the application of the image display voltages in the boundary regions between the neighboring pixels.

The method may further include maintaining an image displayed in each pixel by the application of the image display voltages between applying of the image display voltages and applying of the image display compensation voltages.

A driving voltage having the same multitude and the same polarity may be applied to the first electrode and the second electrode, or the additional driving voltage may be not applied in the step of maintaining the image.

The image display compensation voltage may be applied after applying the image display voltage.

The image display compensation voltage may be applied before applying the reset voltage.

The value of the reset voltage integrated with the corresponding application time may be substantially the same as the value of the reset compensation voltage integrated with the corresponding application time.

The value of the image display voltage integrated with the corresponding application time may be substantially the same as the value of the image display compensation voltage integrated with the corresponding application time.

The pixels may respectively display a first color by the application of the reset voltage, a fifth color by the application of the reset compensation voltage, and one of from the first color to the fifth color by the application of the image display voltage.

The first color may be black and the fifth color may be white, and the luminance of the color may be gradually brighter from the first color to the fifth color.

The reset voltage and the reset compensation voltage may be the same multitude and have reversed polarity to each other, and the image display voltage may include a first sub-image display voltage having the same polarity and multitude as the reset voltage and a second sub-image display voltage having the same multitude and polarity as the reset compensation voltage.

The reset voltage, the reset compensation voltage, the image display voltage, and the image display compensation voltage may be respectively applied during a first time, and the first sub-image display voltage may be applied during the first time to display the first color in the pixels by the application of the image display voltage. The second sub-image display voltage may be applied during a second time, and then the first sub-image display voltage may be applied during a fifth time to display the second color in the pixels by the application of the image display voltage. The second sub-image display voltage may be applied during a third time, and then the first sub-image display voltage may be applied during a sixth time to display the third color in the pixels by the application of the image display voltage. The second sub-image display voltage may be applied during a fourth time, and then the first sub-image display voltage may be applied during a seventh time to display the fourth color in the pixels by the application of the image display voltage. The second sub-image display voltage may be applied during the first time to display the fifth color in the pixels by the application of the image display voltage.

The image display compensation voltage may include a first sub-image display compensation voltage having the same multitude and polarity as the reset voltage and a second sub-image display compensation voltage having the same multitude and polarity as the reset compensation voltage, and the application times of the first sub-image display compensation voltage and the second sub-image display compensation voltage respectively may be the same as the application times of the first image display voltage and the second image display voltage.

The length of the second, third, and fourth times may be respectively ¼ time, ⅔ time, and ¾ time of the length of the first time, and the length of the fifth, sixth, and seventh times may be respectively ¾ time, ⅔ time, and ¼ time of the length of the first time.

When a driving end signal is applied to the electrophoretic display in the step for applying the image display voltage, the driving may be finished after the completion of the step for applying the image display compensation voltage.

When a driving end signal is applied to the electrophoretic display in the step for applying the image display voltage, the driving may be finished after the completion of the step for applying the image display voltage, but when a driving start signal is applied to the electrophoretic display, the image display compensation voltage may be applied, and then the reset compensation voltage may be applied.

When a driving end signal is applied to the electrophoretic display in the step for applying the image display voltage, the driving may be finished after the completion of the step for applying the image display voltage.

The electrophoretic layer may include electrophoretic members having micro capsules enclosing a dielectric fluid in which the electrophoretic particles are disposed, and a fixing resin fixing the electrophoretic members, and at least a portion of the electrophoretic members may be disposed between neighboring pixels.

Also, an electrophoretic display according to an exemplary embodiment of the present invention includes a plurality of gate lines formed on a first insulating substrate, a plurality of data lines intersecting the gate lines and defining a plurality of pixels, a plurality of thin film transistors connected to the gate lines and the data lines, a plurality of pixel electrodes corresponding to the pixels and applied with a first voltage having the same or reversed polarity to the interval between the neighboring pixels, a common electrode formed on a second insulating substrate opposite to the first insulating substrate and applied with a second voltage, and an electrophoretic layer including electrophoretic particles and disposed between the pixel electrodes and the common electrode.

A potential distribution having symmetry with respect to neighboring pixels may be formed in the boundary region between the neighboring pixels.

DETAILED DESCRIPTION OF THE EMBODIMENTS

Figure 1:
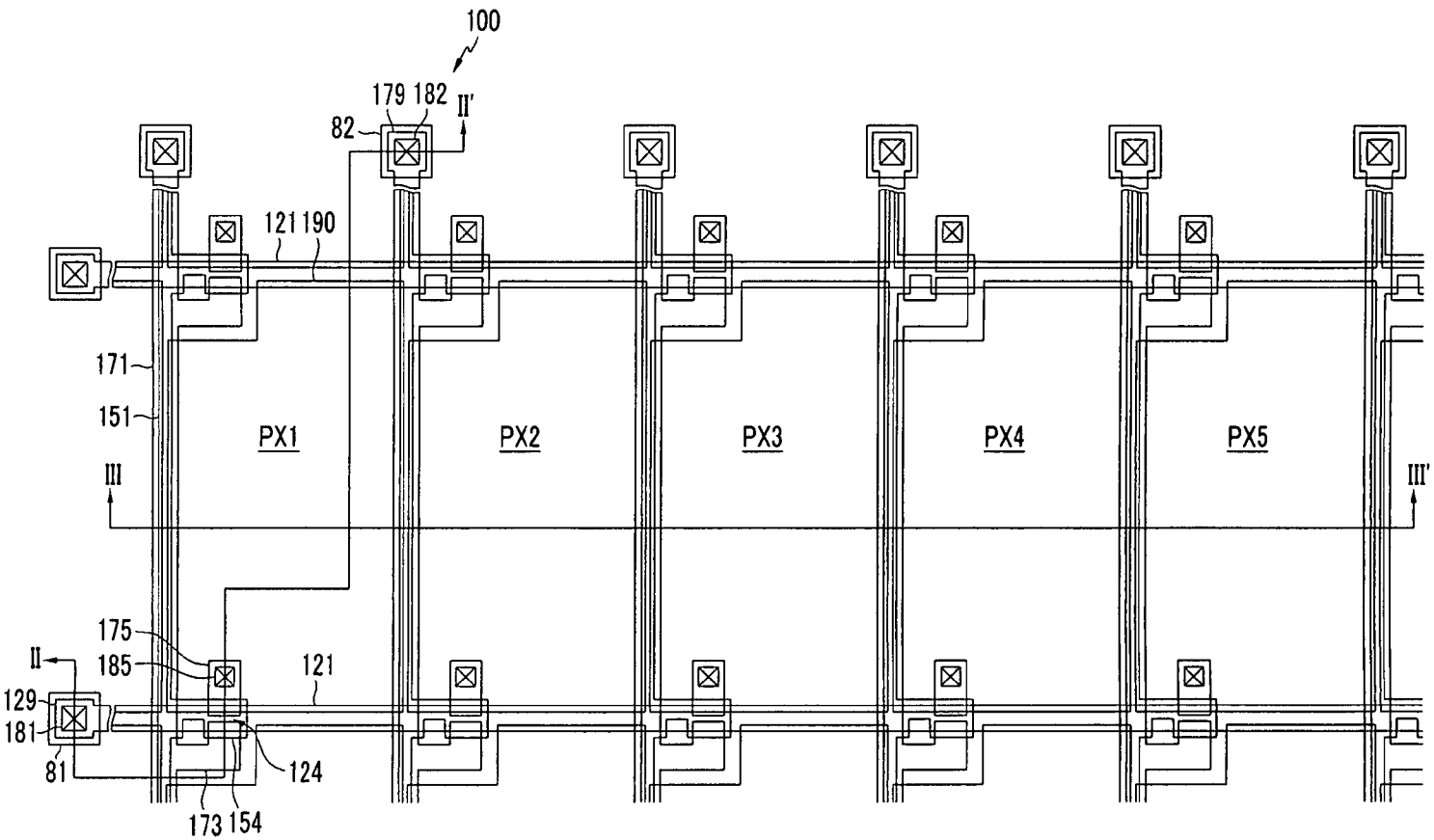
FIG. 1 shows a layout of an electrophoretic display driven by a method for driving the electrophoretic display according to an exemplary embodiment of the present invention.

The present invention is described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Various methods for driving an electrophoretic display according to an exemplary embodiment of the present invention are described below in detail with reference to the accompanying drawings.

Firstly, an electrophoretic display is described in detail with reference to FIG. 1 to FIG. 4 before explanation of the method for driving the electrophoretic display according to exemplary embodiments of the present invention.

Figure 2:
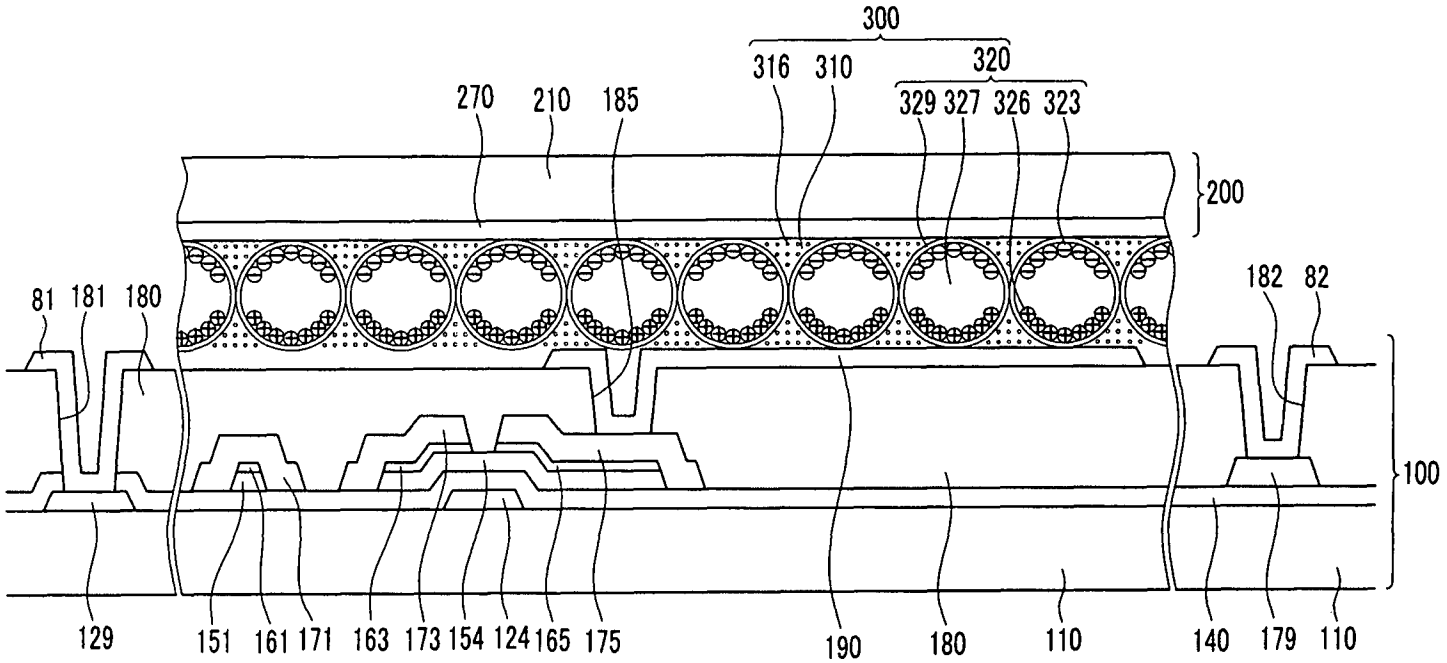
FIG. 2 is a cross-sectional view of the electrophoretic display shown in FIG. 1 taken along the line II-II'.
Figure 3:
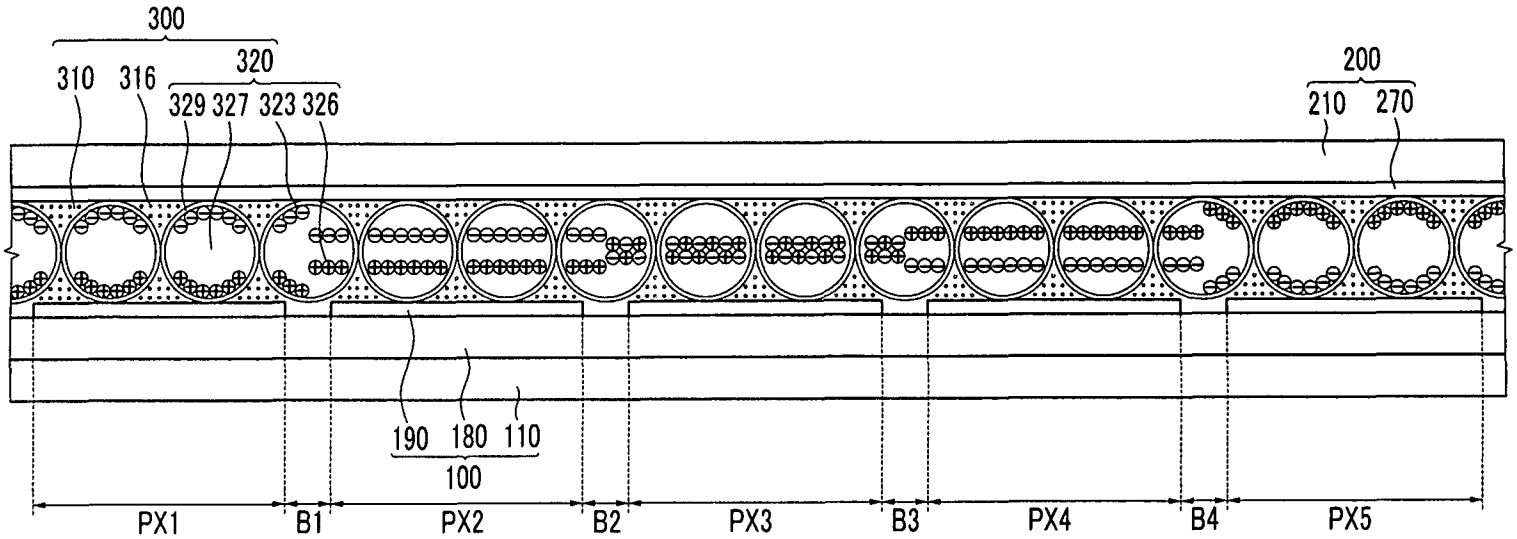
FIG. 3 is a cross-sectional view of the electrophoretic display shown in FIG. 1 taken along the line III-III' to explain a method for respectively displaying the different images of five pixels.
Figure 4:
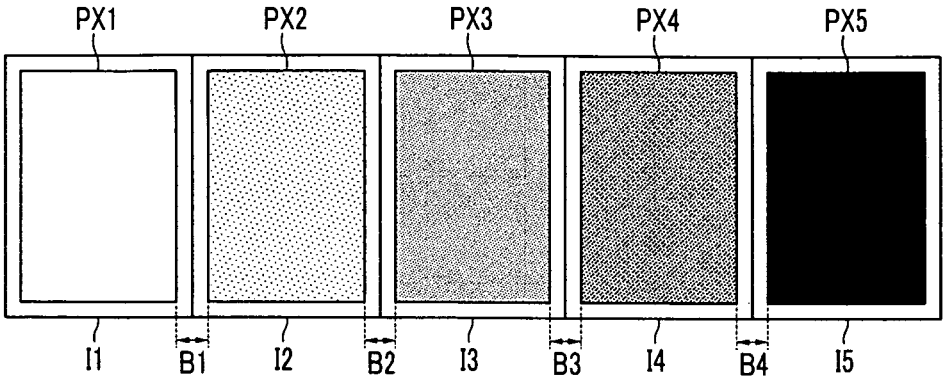
FIG. 4 is a view showing the images of five neighboring pixels in the electrophoretic display of FIG. 3.

FIG. 1 shows a layout of an electrophoretic display driven by a method for driving an electrophoretic display according to an exemplary embodiment of the present invention, FIG. 2 is a cross-sectional view of the electrophoretic display shown in FIG. 1 taken along the line II-II, FIG. 3 is a cross-sectional view of the electrophoretic display shown in FIG. 1 taken along the line III-III to explain a method for respectively displaying different images of five pixels, and FIG. 4 is a view showing the images of five neighboring pixels in the electrophoretic display of FIG. 3.

An electrophoretic display includes a thin film transistor array panel 100, a common electrode panel 200 facing the thin film transistor array panel 100, and an electrophoretic layer 300 disposed between the display panels 100 and 200.

First, the thin film transistor array panel 100 will be described in detail.

Referring to FIG. 1 to FIG. 3, a plurality of gate lines 121 for transmitting gate signals are formed on an insulating substrate 110, which is preferably made of transparent glass or plastic. The gate lines 121 extend substantially in a transverse direction and each gate line 121 includes a plurality of gate electrodes 124 and an end portion 129 having a large area for connection with another layer or an external driving circuit.

A gate insulating layer 140, typically made of silicon nitride SiNx, is formed on the gate lines 121.

A plurality of semiconductor stripes 151 which are typically made of a hydrogenated amorphous silicon a-Si are formed on the gate insulating layer 140. The semiconductor stripes 151 extend in a vertical direction, and include a plurality of protrusions 154 extended toward the gate electrodes 124. Also, the semiconductor stripes 151 have a width that widens near the gate lines 121, and widely covers the gate lines 121.

A plurality of ohmic contact stripes and islands 161 and 165, preferably made of a material such as n+ hydrogenated amorphous silicon in which an n-type impurity such as phosphor is doped with a high density or silicide, are formed on the semiconductor stripes 151. The ohmic contact stripes 161 include a plurality of protrusions 163, and the protrusions 163 and the ohmic contact islands 165 are provided in pairs on the protrusions 154 of the semiconductor stripes 151.

A plurality of data lines 171 and a plurality of drain electrodes 175 are formed on the ohmic contacts 161 and 165 and the gate insulating layer 140

The data lines 171 are used to transmit data signals and extend substantially in a vertical direction so as to cross the gate lines 121. Each of the data lines 171 includes a plurality of source electrodes 173 extending toward the gate electrodes 124 and curved with a 'J' shape, and an end portion 179 having a large area so as to be connected to another layer or an external driving circuit. A pair of one source electrode 173 and one drain electrode 175 are separated from each other and disposed on opposite sides with respect to a gate electrode 124.

The data lines 171 and the drain electrodes 175 may be made of a refractory metal such as molybdenum, chromium, thallium, and titanium, or their alloys. The data lines 171 and the drain electrodes 175 can have a multi-layered structure including a lower layer (not shown) including a metal such as molybdenum, a molybdenum alloy, or chromium, and an upper layer (not shown) including a metal such as aluminum.

A gate electrode 124, a source electrode 173, a drain electrode 175, and a projection 154 of the semiconductor stripes 151 form a thin film transistor (TFT), and a channel of the thin film transistor is provided to the protrusions 154 between the source electrode 173 and the drain electrode 175.

The ohmic contacts 161 and 165 are interposed between the underlying semiconductor stripes 151 and the overlying data lines 171 and drain electrodes 175 thereon, and reduce the contact resistance therebetween.

The semiconductor stripes 151 include a plurality of exposed portions that are not covered with the data lines 171 and the drain electrodes 175, such as portions located between the source electrodes 173 and the drain electrodes 175. Although the semiconductor stripes 151 are narrower than the data lines 171 at most places, the width of the semiconductor stripes 151 becomes large near the gate lines 121, as described above, to enhance the insulation between the gate lines 121 and the data lines 171.

A passivation layer 180 is formed in a single-layered or multi-layered structure on the data lines 171, the drain electrodes 175, and the exposed portions of the semiconductor stripes 151. The passivation layer 180 is preferably made of a photosensitive organic material that easily forms a flat top surface, a low dielectric insulating material such as a-Si:C:O and a-Si:O:F formed by plasma enhanced chemical vapor deposition (PECVD), or an inorganic material such as silicon nitride. For example, if the passivation layer 180 is formed of an organic material, to prevent the organic material of the passivation layer 180 from contacting with the semiconductor stripes 151 exposed between the data lines 171 and the drain electrodes 175, the passivation layer 180 can be structured in such a way that an insulating layer (not shown) made of SiNx or SiO2 is additionally formed under the organic material layer.

The passivation layer 180 has a plurality of contact holes 181, 182, and 185 exposing the end portions 129 of the gate lines 121, the end portions 179 of the data lines 171, and the drain electrodes 175, respectively.

A plurality of pixel electrodes 190 and a plurality of contact assistants 81 and 82, which are preferably made of ITO, IZO, or an opaque metal, are formed on the passivation layer 180.

The pixel electrodes 190 are physically and electrically connected to the drain electrodes 175 through the contact holes 185 such that the pixel electrodes 190 receive the data voltages from the drain electrodes 175 to apply a data voltage to respective electrophoretic layer 300

The contact assistants 81 and 82 are respectively connected to the exposed end portions 129 and 179 of the gate lines 121 and the data lines 171 through the contact holes 181 and 182. The contact assistants 81 and 82 protect the exposed end portions 129 and 179 of the gate lines 121 and the data lines 171 and complement the adhesion between the exposed portions and external devices such as a driving integrated circuit.

Below, the common electrode panel 200 is described.

The common electrode panel 200 is opposed to the thin film transistor array panel 100, and includes a transparent insulating substrate 210 and a common electrode 270 formed on the insulating substrate 210.

The common electrode 270 is a transparent electrode made of ITO or IZO and applies a common voltage to respective electrophoretic particles 323 and 326 of the electrophoretic layer 300.

The common electrode 270 applying a common voltage changes the positions of the electrophoretic particles 323 and 326 by applying an image display voltage to the respective electrophoretic particles 323 and 326 along with the pixel electrodes 190 applying a data voltage, thereby displaying images of colored or white/black grays.

Below, the electrophoretic layer 300 is described.

The electrophoretic layer 300 is disposed on a plurality of pixels PX provided between the pixel electrodes 190, which are separated from each other, and the common electrode 270 facing the pixel electrodes 190, and in the boundary regions B between the pixels. The pixels PX and the boundary regions B are repeatedly arranged in up and down and left and right directions on the plane, but the arbitrary five pixels PX1, PX2, PX3, PX4, and PX5 are shown arranged in a row direction among the plurality of pixels for convenience of explanation in the present exemplary embodiment, and the four boundary regions B1, B2, B3, and B4 that are arranged between the five pixels PX1, PX2, PX3, PX4, and PX5 are shown in FIG. 3 among the plurality of boundary regions B.

Also, the electrophoretic layer 300 includes a plurality of electrophoretic members 320 and a fixing resin 310 for fixing the electrophoretic members 320.

The fixing resin 310 includes an ultraviolet ray hardener 316 and is made of an organic resin hardened by ultraviolet rays such that each electrophoretic member 320 and the two display panels 100 and 200 are fixed to each other. Alternatively, the fixing resin may be made of an organic resin including a thermal hardener.

Each electrophoretic member 320 includes a transparent dielectric fluid 327 and a plurality of micro capsules 329 enclosing first electrophoretic particles 323 and second electrophoretic particles 326 dispersed in the transparent dielectric fluid 327.

The first electrophoretic particles 323 are particles that are colored white and charged with negative charges, and the second electrophoretic particles 326 are particles that are colored black and charged with positive charges. However, the first electrophoretic particles 323 and the second electrophoretic particles 326 may be charged with positive charges and negative charges respectively, conversely to the above description.

The plurality of electrophoretic members 320 are uniformly disposed in the boundary regions B1, B2, B3, and B4 as well as on each pixel PX1, PX2, PX3, PX4, and PX5.

Next, methods for displaying images of different grays in each pixel PX1, PX2, PX3, PX4, and PX5 of the electrophoretic display according to an exemplary embodiment of the present invention are described with reference to FIG. 3 and FIG. 4.

As shown in FIG. 3, the electrophoretic particles 323 and 326 have five different arrangements between the pixel electrodes 190 and the common electrode 270 responsive to the application of the driving voltages, corresponding to the difference between the common voltage applied to the common electrode 270 and the data voltage applied to the pixel electrodes 190, to the electrophoretic particles 323 and 326 disposed in each pixel PX1, PX2, PX3, PX4, and PX5.

The first electrophoretic particles 323 in the first pixel PX1 are arranged close to the common electrode 270, and the second electrophoretic particles 326 are arranged close to the pixel electrodes 190. Accordingly, most of the light incident on the first pixel PX1 from the external source is reflected by the first electrophoretic particles 323. Therefore, as shown in FIG. 4, the first pixel PX1 displays the fourth gray image having the brightest white of highest gray level.

In the second pixel PX2, the first and second electrophoretic particles 323 and 326 are disposed between the pixel electrodes 190 and the common electrode 270, with most of the first electrophoretic particles 323 disposed closer to the common electrode 270 and most of the second electrophoretic particles 326 disposed closer to the pixel electrodes 190. Accordingly, a large amount of the external light incident on the second pixel PX2 from the external source is reflected by the first electrophoretic particles 323 of white color. Therefore, as shown in FIG. 4, the second pixel PX2 displays the third gray image that is blacker than the fourth gray image of white color and has a weak ash color.

Also, the first and second electrophoretic particles 323 and 326 in the third pixel PX3 are disposed in the central portion between the pixel electrodes 190 and the common electrode 270. Accordingly, a portion of the external light incident on the third pixel PX3 from the external source is reflected by the first electrophoretic particles 323 of white color and the rest of the external light is absorbed by the second electrophoretic particles 326 of black color. Therefore, as shown in FIG. 4, the third pixel PX3 displays an image of the second gray that is darker than the third gray of weak ash color and is a middle ash color.

Also, the first and second electrophoretic particles 323 and 326 in the fourth pixel PX4 are disposed between the pixel electrodes 190 and the common electrode 270, with the first electrophoretic particles 323 arranged closer to the pixel electrodes 190 and the second electrophoretic particles 326 disposed closer to the common electrode 270. Accordingly, a large amount of the external light is absorbed by the second electrophoretic particles 326 with black color. Therefore, as shown in FIG. 4, the fourth pixel PX4 displays the first gray image that is blacker than the second gray of middle ash color and is a dark ash color.

Finally, the first electrophoretic particles 323 are disposed closer to the pixel electrodes 190 and the second electrophoretic particles 326 are disposed closer to the common electrode 270 in the fifth pixel PX5. Accordingly, most of the external light incident on the fifth pixel A5 is absorbed by the second electrophoretic particles 326 with black color. Therefore, as shown in FIG. 4, the fifth pixel PX5 displays the 0 gray image that is the lowest gray and is the blackest color.

It is possible that the electrophoretic particles 323 and 326 disposed in each pixel PX1, PX2, PX3, PX4, and PX5 are disposed with five different arrangements, as above described. Accordingly, each pixel PX1, PX2, PX3, PX4, and PX5 may display a gray of black and white such they may display the arbitrary desired images.

On the other hand, a potential due to the fringe field is also generated in each boundary region B1, B2, B3, and B4 in the application process of the driving voltage to change the positions of the electrophoretic particles 323 and 326 in each pixel PX1, PX2, PX3, PX4, and PX5. By using the driving method of the electrophoretic display according to an exemplary embodiment of the present invention, the potential formed in each boundary region B1, B2, B3, and B4 is symmetrical with respect to each neighboring pixel PX1, PX2, PX3, PX4, and PX5 with reference to each boundary region B1, B2, B3, and B4. Accordingly, as shown in FIG. 3, the electrophoretic particles 323 and 326 disposed in each boundary region B1, B2, B3, and B4 have the same arrangement as that of the electrophoretic particles 323 and 326 disposed in each pixel PX1, PX2, PX3, PX4, and PX5 by receiving the influence of the driving voltage applied to each neighboring pixel PX1, PX2, PX3, PX4, and PX5.

Accordingly, as shown in FIG. 4, the regions of the images substantially displayed in each pixel PX1, PX2, PX3, PX4, and PX5 are uniformly extended into image display areas I1, I2, I3, I4, and I5. Accordingly, the images substantially displayed in each pixel PX1, PX2, PX3, PX4, and PX5 are uniformly extended along with size uniformity.

The driving methods of the electrophoretic display according to an exemplary embodiment of the present invention are described below in detail with reference to FIG. 3 to FIG. 11.

Figure 5:
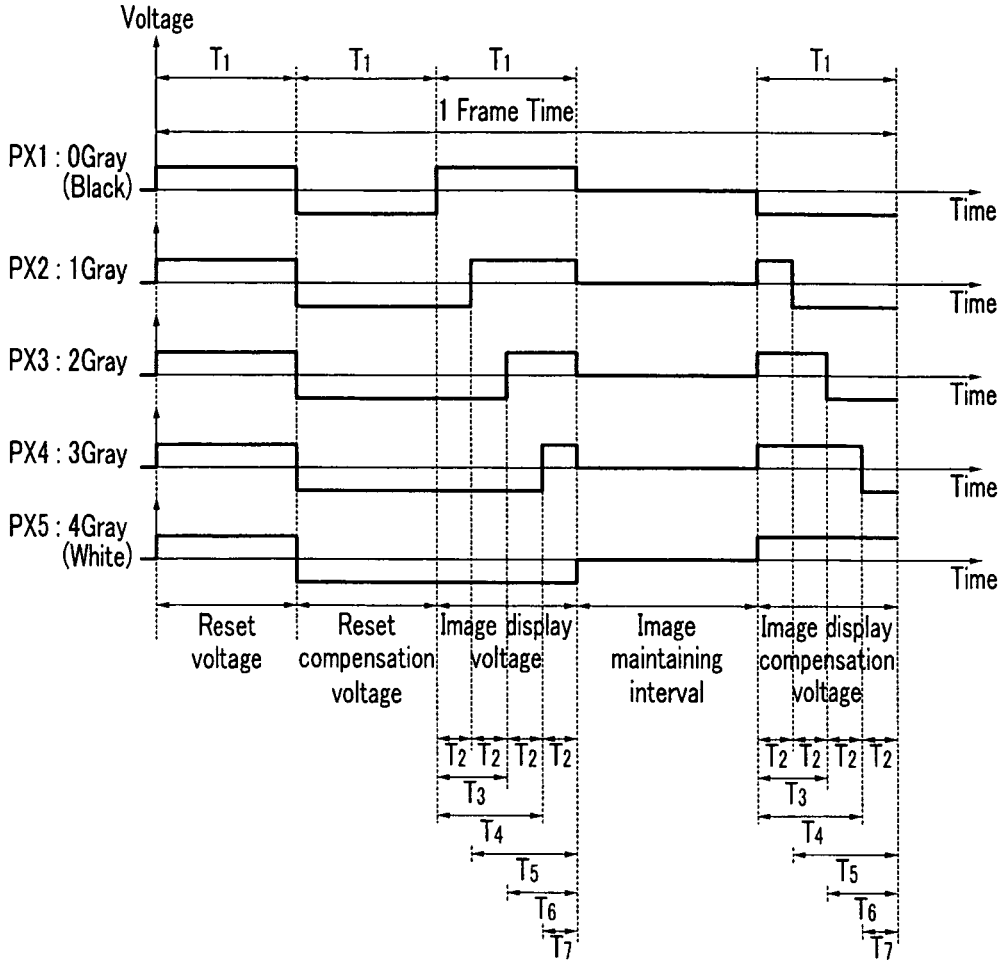
FIG. 5 is a timing diagram showing driving voltages applied to the electrophoretic particles disposed in the predetermined pixels per time to explain a method for driving an electrophoretic display according to a first exemplary embodiment of the present invention.
Figure 6:
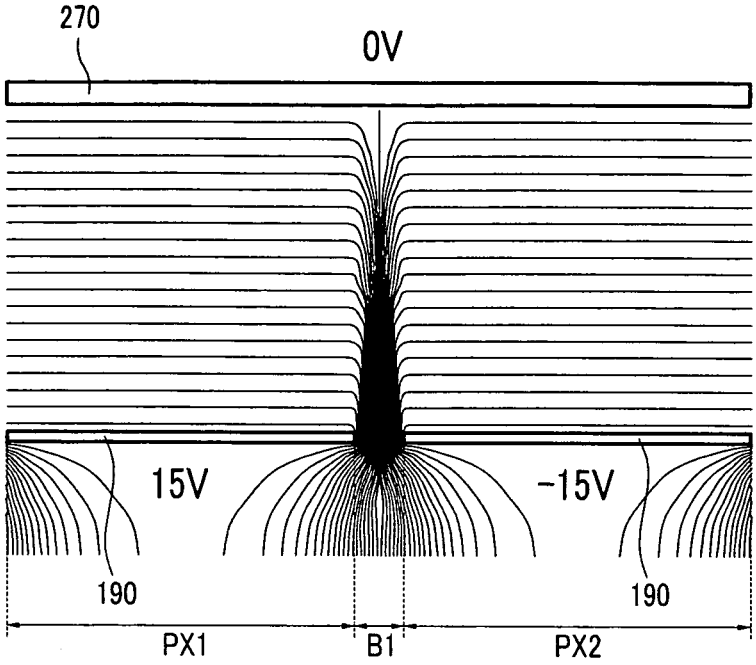
FIG. 6 is a cross-sectional view showing the potential distribution between the neighboring pixels in the predetermined time by the application of the image display voltage according to the driving method of FIG. 5.
Figure 7:
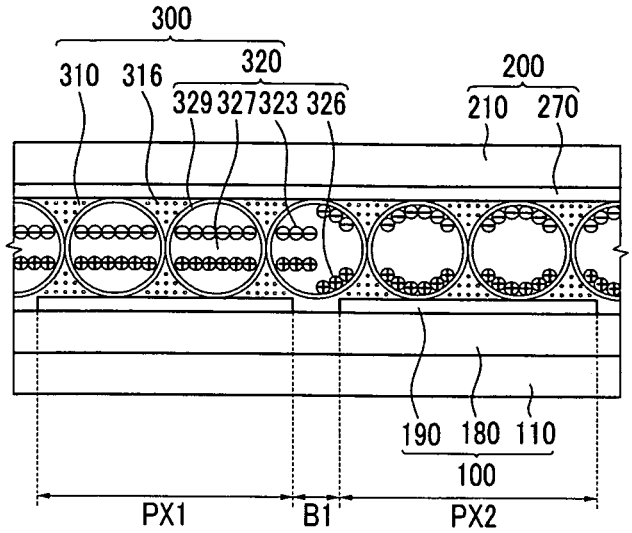
FIG. 7 is a cross-sectional view of a portion of the electrophoretic display showing the result of the movement of the electrophoretic particles according to the potential distribution of FIG. 6.
Figure 8:
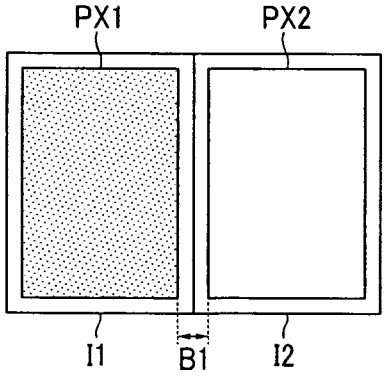
FIG. 8 is a view showing images of two neighboring pixels according to the potential distribution of FIG. 6 and the movement of the electrophoretic particles of FIG. 7.
Figure 9:
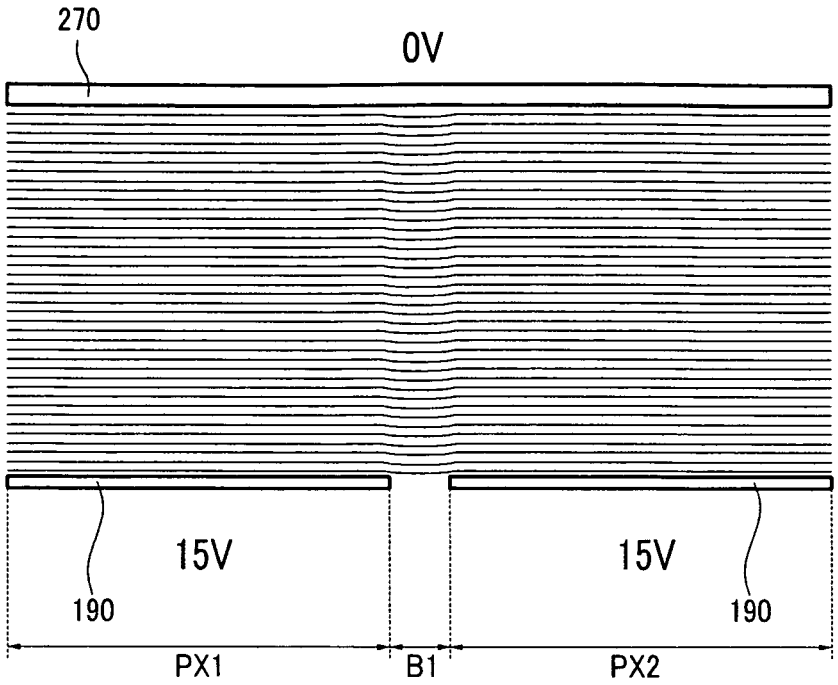
FIG. 9 is a cross-sectional view of a portion of the electrophoretic display showing the potential distribution between neighboring pixels after the predetermined time of FIG. 6 by the application of the image display voltage according to the driving method of FIG. 5.
Figure 10:
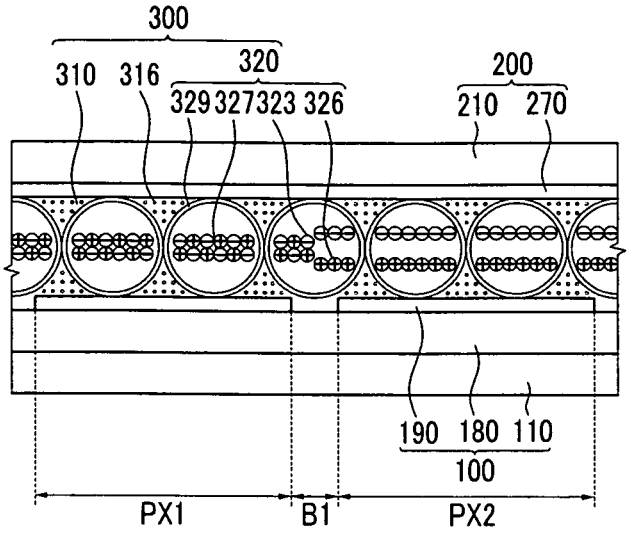
FIG. 10 is a cross-sectional view of the electrophoretic display showing the result of the movement of the electrophoretic particles according to the potential distribution of FIG. 9.
Figure 11:
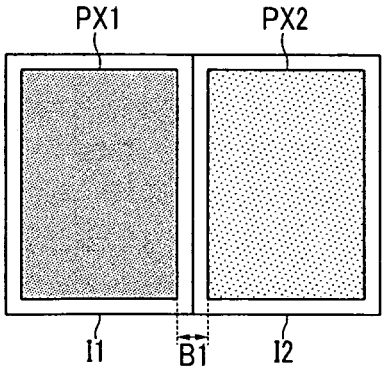
FIG. 11 shows images of two neighboring pixels according to the potential distribution of FIG. 9 and the movement of the electrophoretic particles of FIG. 10.

FIG. 5 is a view showing driving voltages applied to the electrophoretic particles disposed in the predetermined pixels per time to explain a method for driving an electrophoretic display according to an exemplary embodiment of the present invention, FIG. 6 is a cross-sectional view showing the potential distribution between neighboring pixels in the predetermined time by the application of the image display voltage according to the driving method of FIG. 5. FIG. 7 is a cross-sectional view of the electrophoretic display showing the movement of the electrophoretic particles according to the potential distribution of FIG. 6, and FIG. 8 is a view showing images of the two neighboring pixels according to the potential distribution of FIG. 6 and the movement of the electrophoretic particles of FIG. 7. FIG. 9 is a cross-sectional view of the electrophoretic display showing the potential distribution between the neighboring pixels after the predetermined time of FIG. 6 by the application of the image display voltage according to the driving method of FIG. 5. FIG. 10 is a cross-sectional view of the electrophoretic display showing the movement of the electrophoretic particles according to the potential distribution of FIG. 9, and FIG. 11 shows images of the two neighboring pixels according to the potential distribution of FIG. 9 and the movement of the electrophoretic particles of FIG. 10.

Firstly, in the driving method of the electrophoretic display according to an exemplary embodiment of the present invention, it is assumed that the first pixel PX1, the second pixel PX2, the third pixel PX3, the fourth pixel PX4, and the fifth pixel PX5 respectively display images of a 0 gray, a first gray, a second gray, a third gray, and a fourth gray during an image maintaining interval. Firstly, the various driving voltages mean the values that subtract data voltages applied to the pixel electrodes from the common voltage as a reference voltage applied to the common electrode, regarding FIG. 5, and are respectively defined as follows.

Referring to FIG. 5, the following are shown: a reset voltage, a first sub-image display voltage, and a second sub-image display compensation voltage: a voltage of positive level for the first electrophoretic particles 323 to overcome the fluid resistance of the transparent dielectric fluid 327 and move toward the pixel electrodes 190 and for the second electrophoretic particles 326 to overcome the fluid resistance of the transparent dielectric fluid 327 and move toward the common electrode 270. The voltages are about 15V in this embodiment.

Also shown in FIG. 5 are: a reset compensation voltage, a second sub-image display voltage, and a first sub-image display compensation voltage: a voltage of negative level for the first electrophoretic particles 323 to overcome the fluid resistance of the transparent dielectric fluid 327 and move toward the common electrode 270 and for the second electrophoretic particles 326 to overcome the fluid resistance of the transparent dielectric fluid 327 and move toward the pixel electrodes 190. This substantially has the same magnitude as the reset voltage, the first sub-image display voltage, and the second sub-image display compensation voltage while having reversed polarity. The voltages are about −15V in the present exemplary embodiment.

Here, the sum of the first sub-image display voltage and the second sub-image display voltage is defined as an image display voltage and the sum of the first sub-image display compensation voltage and the second sub-image display compensation voltage is defined as an image display compensation voltage.

Also, the time for applying the various driving voltages is defined as follows regarding FIG. 5. Here, each application time is denoted by Arabic numerals, but the application time with a small numeral is not necessarily longer than or precede the application time with a large numeral.

First time T1: a total application time of each reset voltage, reset compensation voltage, image display voltage, and image display compensation voltage applied to the first electrophoretic particles 323 and the second electrophoretic particles 326.

Second time T2 and seventh time T7: about ¼ time of the length of the first time T1, and the time that the electrophoretic particles 323 and 326 move at the ¼ time of the distance between the pixel electrodes 190 and the common electrode 270.

Third time T3 and sixth time T6: about ⅔ time corresponding to the length of the first time T1, and the time that the electrophoretic particles 323 and 326 move at the ⅔ time of the distance between the pixel electrodes 190 and the common electrode 270.

Fourth time T4 and fifth time T5: about ¾ time corresponding to the length of the first time T1, and the time that the electrophoretic particles 323 and 326 move at the ¾ time of the distance between the pixel electrodes 190 and the common electrode 270.

In the driving method of the electrophoretic display according to an exemplary embodiment of the present invention, as shown in FIG. 5, the reset voltage is applied to the electrophoretic particles 323 and 326 disposed in each pixel PX1, PX2, PX3, PX4, and PX5 during the first time T1 to display a reset image in the electrophoretic display.

The first electrophoretic particles 323 and the second electrophoretic particles 326 disposed in each pixel PX1, PX2, PX3, PX4, and PX5 respectively move and are arranged to the common electrode 270 and the pixel electrodes 190 the same as the fifth pixel PX5 of FIG. 3 through the application of the reset voltage.

Accordingly, as shown in FIG. 7, each pixel PX1, PX2, PX3, PX4, and PX5 displays images of the 0 gray of black color same as the fifth pixel PX5 of FIG. 4, such that the electrophoretic display wholly displays the black color image as the reset image.

Next, as shown in FIG. 5, the reset compensation voltage is applied to the electrophoretic particles 323 and 326 disposed in each pixel PX1, PX2, PX3, PX4, and PX5 during the first time T1 after the application of the reset voltage.

The first electrophoretic particles 323 and the second electrophoretic particles 326 disposed in each PX1, PX2, PX3, PX4, and PX5 move to the pixel electrodes 190 and the common electrode 270 and are arranged as the first pixel PX1 of FIG. 3 by the application of the reset compensation voltage.

Accordingly, each pixel PX1, PX2, PX3, PX4, and PX5 displays the fourth gray image that is the highest white color, same as the first pixel PX1 of FIG. 4, and the electrophoretic display wholly displays the white image as a reset compensation image.

Here, because the value of the reset voltage integrated by the application time T1 is substantially the same as the value of the reset compensation voltage integrated by the application time T1, charges that stimulate the pixel electrodes 190 and the common electrode 270 are prevented. Differing from the present exemplary embodiment, the reset voltage, the reset compensation voltage, and the application time may be respectively changed under the condition that the value of the reset voltage integrated by the application time T1 is substantially the same as the value of the reset compensation voltage integrated by the application time T1.

Next, as shown in FIG. 5, the image display voltage is applied to each pixel PX1, PX2, PX3, PX4, and PX5 to substantially display the desired image through the electrophoretic display after the application of the reset compensation voltage.

In detail, the first sub-image display voltage is applied to the first pixel PX1 during the first time T1. On the other hand, the second sub-image display voltage is applied to the second pixel PX2 during the second time T2, and then the first sub-image display voltage is applied during the fifth time T5. Also, the second sub-image display voltage is applied to the third pixel PX3 during the third time T3, and then the first sub-image display voltage is applied during the sixth time T6. Also, the second sub-image display voltage is applied to the fourth pixel PX4 during the fourth time T4, and then the first sub-image display voltage is applied during the seventh time T7.

Accordingly, as shown in FIG. 6, an equipotential distribution that is parallel to the pixel electrodes 190 and the common electrode 270 and has the high potential of the pixel electrodes 190 is formed in the first pixel PX1 during the second time T2, and an equipotential distribution that is parallel to the pixel electrodes 190 and the common electrode 270 and has the high potential of the common electrode 270 is formed in the second pixel PX2. Therefore, the electrophoretic particles 323 and 326 in each first pixel PX1 and second pixel PX2 are arranged as shown in FIG. 7. Accordingly, the first pixel PX1 and the second pixel PX2 respectively display the images of the third gray and the fourth gray, as shown in FIG. 8.

Here, an equipotential distribution that is symmetrical with respect to the first pixel PX1 and the second pixel PX2 is formed in the boundary region B1, as shown in FIG. 6. Accordingly, as shown in FIG. 7, the electrophoretic particles 323 and 326 disposed in the boundary region B1 are influenced by the first sub-image display voltage generating the equipotential distribution in each first pixel PX1 and the second sub-image display voltage generating the equipotential distribution in each second pixel PX2 according to their positions. Therefore, the electrophoretic particles 323 and 326 disposed in the boundary region B1 are respectively arranged with the same arrangement as the electrophoretic particles 323 and 326 disposed in the pixels PX1 and PX2 that are the closest thereto.

Accordingly, as shown in FIG. 8, the regions of the first pixel PX1 and the second pixel PX2 for displaying the images are uniformly expanded into the first image display area I1 and the second image display area I2 the same as in the pixels themselves.

Further, an equipotential distribution is also formed in the third to fifth pixels PX3, PX4, and PX5 as in the second pixel PX2. Accordingly, the electrophoretic particles 323 and 326 in each of the third to fifth pixels PX3, PX4, and PX5 are arranged the same as the second pixel PX2. Therefore, the third to fifth pixels PX3, PX4, and PX5 also display the same images of the fourth gray as that of the second pixel PX2.

Also, since the same equipotential distribution is wholly formed in the second to fifth pixels PX2, PX3, PX4, and PX5, equipotential distributions that are symmetrical with respect to the pixels PX2, PX3, PX4, and PX5 are formed in the boundary regions B2, B3, and B4 between the second to fifth pixels PX2, PX3, PX4, and PX5. Accordingly, the electrophoretic particles 323 and 326 disposed in each boundary region B2, B3, and B4 are arranged the same as the electrophoretic particles 323 and 326 in the second to fifth pixels PX2, PX3, PX4, and PX5. Therefore, the regions of the third to fifth pixels PX3, PX4, and PX5 for substantially displaying the images are uniformly expanded with the same size as the second image display area I2 of the second pixel PX2 the same as in the pixels themselves.

Next, as shown in FIG. 9, equipotential distributions where the potential of the pixel electrodes 190 is higher than that of the common electrode 270 are formed in the first pixel PX1 and the second pixel PX2 during the second time T2 of the second time after the passage of the initial second time T2. Accordingly, the electrophoretic particles 323 and 326 of each of the first pixel PX1 and the second pixel PX2 are arranged by the application of the image display voltage during the third time T3, as in FIG. 10. Therefore, the first pixel PX1 and the second pixel PX2 respectively display the images of the second gray and the third gray, as shown in FIG. 11.

Also, an equipotential distribution that is symmetrical with respect to the first pixel PX1 and the second pixel PX2 is formed in the boundary region B1, as shown in FIG. 9. Accordingly, as shown in FIG. 10, the electrophoretic particles 323 and 326 disposed in the boundary region B1 are arranged the same as the electrophoretic particles 323 and 326 disposed in the pixels PX1 and PX2 by the influence of the first sub-image display voltages of the first pixel PX1 and the second pixel PX2. Therefore, as shown in FIG. 11, the regions of the first pixel PX1 and the second pixel PX2 for substantially displaying the images are uniformly expanded into the first image display area I1 and the second image display area I2 the same as in the pixels themselves.

Next, as shown in FIG. 9, equipotential distributions where the potential of the common electrode 270 is higher than that of the pixel electrodes 190 and parallel to the common electrode 270 and the pixel electrodes 190 are formed in the third to fifth pixels PX3, PX4, and PX5 during the second second time T2 after the passage of the initial second time T2. Therefore, the electrophoretic particles 323 and 326 of the third to fifth pixels PX3, PX4, and PX5 are arranged with the same state as that of the electrophoretic particles 323 and 326 of the second pixel PX2, as shown in FIG. 7. Accordingly, the third pixel PX3 to the fifth pixel PX5 maintain the images of the fourth gray, as shown in FIG. 8.

However, an equipotential distribution that is symmetrical with respect to the second pixel PX2 and the third pixel PX3 is formed in the boundary region B2 between the second pixel PX2 and the third pixel PX3, like the boundary region B1 shown in FIG. 6. Accordingly, like the boundary region B1 shown in FIG. 7, the electrophoretic particles 323 and 326 disposed in the boundary region B2 receive the influence of the first sub-image display voltage forming the equipotential distribution of the second pixel PX2 and the second sub-image display voltage forming the equipotential distribution of the third pixel PX3, and have the same arrangement states as those of the electrophoretic particles 323 and 326 disposed in the pixels PX2 and PX3. Therefore, the regions of the first pixel PX1 and the second pixel PX2 for substantially displaying the images are uniformly expanded into the same size as the second image display area 12 of the second pixel PX2 the same as in the pixels themselves, as shown in FIG. 9.

Also, equipotential distributions that are symmetrical with the neighboring pixels are formed in each boundary region B3 and B4 between the third to fifth pixels PX3, PX4, and PX5. Accordingly, the electrophoretic particles 323 and 326 disposed in each boundary region B3 and B4 are arranged the same as the electrophoretic particles 323 and 326 disposed in the third to fifth pixels PX3, PX4, and PX5. Therefore, the regions of the fourth and fifth pixels PX4 and PX5 for displaying the real images are uniformly expanded into the same size as the second image display area 12 of the second pixel PX2 the same as in the pixels themselves.

Next, after the passage of the second second time T2 of the second time, the equipotential distribution where the potential of the pixel electrodes 190 is higher than the common electrode 270 is formed during the third second time T2 in the first pixel PX1 to the third pixel PX3. Accordingly, the electrophoretic particles 323 and 326 of the first pixel PX1, the second pixel PX2, and the third pixel PX3 are respectively arranged the same as the electrophoretic particles 323 and 326 of the fourth pixel PX4, the third pixel PX3, and the second pixel PX2 of FIG. 3 by the application of the image display voltage until the fourth time T4.

Accordingly, the first pixel PX1, the second pixel PX2, and the third pixel PX3 respectively display the images of the first gray, the second gray, and the third gray.

Also, equipotential distributions that are symmetrical with respect to the first pixel PX1 and the second pixel PX2 and with the second pixel PX2 and the third pixel PX3 are formed as in FIG. 9 in the first boundary region B1 and the second boundary region B2. Accordingly, the electrophoretic particles of the first boundary region B1 and the second boundary region B2 are arranged the same as the electrophoretic particles 323 and 326 disposed in the third boundary region B3 and the second boundary region B2 as shown in FIG. 3.

Accordingly, the regions substantially displaying in the first pixel PX1, the second pixel PX2, and the third pixel PX3 are respectively and uniformly expanded into the same sizes as the regions of the fourth image display area I4, the third image display area I3, and the second image display area I2 of FIG. 4 the same as in the pixels themselves.

Further, an equipotential distribution where the potential of the common electrode 270 is higher than that of the pixel electrodes 190 and parallel to the common electrode 270 and the pixel electrodes 190 is formed in the fourth and fifth pixels PX4 and PX5 during the third second time T2 after the passage of the second second time T2. Therefore, the arrangement of the electrophoretic particles 323 and 326 of each of the fourth and fifth pixels PX4 and PX5 is maintained the same as the arrangement of the electrophoretic particles 323 and 326 of the second pixel PX2 as in FIG. 7. Accordingly, the fourth pixel PX4 and the fifth pixel PX5 respectively constantly display the images of the fourth gray, as shown in FIG. 8.

Here, an equipotential distribution that is symmetrical with respect to the third pixel PX3 and the fourth pixel PX4 is formed in the boundary region B3 between the third pixel PX3 and the fourth pixel PX4, like the boundary region B1 of FIG. 6. Accordingly, the electrophoretic particles 323 and 326 disposed in the boundary region B3 have the same arrangement as that of the electrophoretic particles 323 and 326 disposed in the boundary region B1 as in FIG. 7. Therefore, the region substantially displaying the image in the fourth pixel PX4 is expanded into the same size as the image display area of the third pixel PX3 the same as in the pixel itself.

Also, the equipotential distribution that is symmetrical with respect to the neighboring fourth and fifth pixels PX4 and PX5 is formed in the boundary region B4 between the fourth and fifth pixels PX4 and PX5. Accordingly, the electrophoretic particles 323 and 326 disposed in the boundary region B4 are substantially arranged the same as the electrophoretic particles 323 and 326 disposed in the fourth to fifth pixels PX4 and PX5. Accordingly, the regions displaying the images in the fourth and fifth pixels PX4 and PX5 are uniformly expanded into the same size as the image display area of the third pixel PX3 the same as in the pixel itself.

Next, an equipotential distribution where the potential of the pixel electrodes 190 is higher than that of the common electrode 270 is formed the same as in FIG. 9 in the first to fourth pixels PX1, PX2, PX3, and PX4 during the fourth second time T2 after the passage of the third second time T2. Accordingly, the electrophoretic particles 323 and 326 in each of the first pixel PX1, the second pixel PX2, the third pixel PX3, and the fourth pixel PX4 are arranged by the application of the image display voltage during the total first time T1 the same as the electrophoretic particles 323 and 326 in the fifth pixel PX5, the fourth pixel PX4, the third pixel PX3, and the second pixel PX2 shown in FIG. 3. Therefore, the first pixel PX1, the second pixel PX2, the third pixel PX3, and the fourth pixel PX4 respectively display the images of the 0 gray, the first gray, the second gray, and the third gray.

Also, equipotential distributions that are respectively symmetrical with respect to the first pixel PX1 and the second pixel PX2, the second pixel PX2 and the third pixel PX3, and the third pixel PX3 and the fourth pixel PX4 are formed in the first boundary region B1, the second boundary region B2, and the third boundary region B3, as shown in FIG. 9. Accordingly, the electrophoretic particles 323 and 326 of the first boundary region B1, the second boundary region B2, and the third boundary region B3 are respectively arranged the same as the electrophoretic particles 323 and 326 disposed in the fourth boundary region B4, the third boundary region B3, and the second boundary region B2 shown in FIG. 3. Therefore, the regions of the images substantially displayed in the first pixel PX1, the second pixel PX2, the third pixel PX3, and the fourth pixel PX4 are uniformly expanded into the same size as the region of the fifth image display area I5, the fourth image display area I4, the third image display area I3, and the second image display area I2, which are shown in FIG. 4, the same as in the pixels themselves.

On the other hand, an equipotential distribution where the potential of the common electrode 270 is higher than that of the pixel electrodes 190 and parallel to the common electrode 270 and the pixel electrodes 190 is formed in the fifth pixel PX5 during the fourth second time T2 after the passage of the third second time T2. Therefore, the arrangement of the electrophoretic particles 323 and 326 in the fifth pixel PX5 is the same as the electrophoretic particles 323 and 326 in the second pixel PX2 as shown in FIG. 7. Accordingly, the fifth pixel PX5 constantly displays an image of the fourth gray.

Also, an equipotential distribution that is symmetrical with respect to the fourth pixel PX4 and the fifth pixel PX5 is formed in the boundary region B4 between the fourth pixel PX4 and the fifth pixel PX5 like the boundary region B1 shown in FIG. 6. Accordingly, the electrophoretic particles 323 and 326 disposed in the boundary region B4 have the same arrangement as the electrophoretic particles 323 and 326 disposed in the boundary region B1 of FIG. 7. Therefore, the region of the image substantially displayed in the fifth pixel PX3 is uniformly expanded into the same size as the region of the image display area 14 of the fourth pixel PX4 the same as in the pixel itself.

According to the application method of the image display voltage, through the application time of the image display voltage to display the images of the different grays, the total time for applying the image display voltage is controlled to be the same by properly applying the voltage having the same or reversed polarity. That is to say, to control the total application time of the image display compensation voltage of each pixel to be the same, the second sub-image display voltage that is the same voltage as the reset compensation voltage is pre-applied to the pixel that fast displays the desired image during the remaining time, and the first sub-image display voltage is applied during the required time to display the desired image.

According to the driving method, the predetermined pixel where the desired image is completed is not applied with the image display voltage, and a different predetermined pixel where the desired image is not completed is applied with the image display voltage such the potential generated in the pixel applied with the image display voltage prevents an imbalanced potential distribution from being formed between the two pixels and may form a potential distribution having symmetry with respect to the two pixels. Therefore, the movement of the electrophoretic particles is the same as the movement of the electrophoretic particles disposed in the closer pixel in the boundary region such that it is prevents changing the size of the image in the process of the application of the image display voltage, thereby improving the display performance of the display device.

The image displayed in each pixel PX1, PX2, PX3, PX4, and PX5 is continued during the following image maintaining interval through the application of the image display voltage. The image may be maintained in the image display maintaining interval by applying the voltage having the same polarity and multitude to the pixel electrodes 190 and the common electrode 270, or not applying the additional driving voltage. On the other hand, the image maintaining interval may be omitted as necessary, differently from the present exemplary embodiment.

Next, the image maintaining interval is finished, the image display compensation voltage is applied to remove the stimulated charges on the pixel electrodes 190 or the common electrode 270 of each pixel PX1, PX2, PX3, PX4, and PX5 in the driving process of the image display voltage.

That is to say, the value of the image display compensation voltage integrated with the corresponding application time can be substantially the same as the value of the image display voltage integrated with the corresponding application time such that stimulation of charges in the pixel electrodes 190 and the common electrode 270 of each pixel PX1, PX2, PX3, PX4, and PX5 is prevented. Accordingly, an afterimage may be prevented thereby improving the display performance of the electrophoretic display.

When describing this process through FIG. 5, the image display voltage and the voltage having the reversed polarity are applied to each pixel PX1, PX2, PX3, PX4, and PX5 in the step for applying the image display compensation voltage.

That is to say, the first sub-image display compensation voltage that has the reversed polarity and the same multitude as the first sub-image display voltage is applied during the application time of the first sub-image display voltage, and the second sub-image display compensation voltage that has the reversed polarity and the same multitude as the second sub-image display voltage is applied during the application time of the second sub-image display voltage.

On the other hand, different from the present exemplary embodiment, the image display voltage, the image display compensation voltage, and the corresponding times may be changed under the condition that the value of the image display compensation voltage integrated with the corresponding application time is the same as the value of the image display voltage integrated with the corresponding application time.

When the above described process is completed and at least one of each of the pixels PX1, PX2, PX3, PX4, and PX5 will display a different image from the previous image, the above explained driving process is repeatedly executed.

However, before the above described process is completed, that is, when the driving end signal is applied to the electrophoretic display in the step for applying the image display voltage, the driving may be finished after the completion of the step for applying the image display voltage In this case, if a driving start signal is applied to the electrophoretic display, the step for applying the image display compensation voltage is executed to prevent the charges from stimulating the pixel electrodes 190 and the common electrode 270 of each of the pixels PX1, PX2, PX3, PX4, and PX5, and then the step for applying the reset compensation voltage to the step for applying the image display compensation voltage may be repeatedly executed. On the other hand, when the step for applying the image display compensation voltage is completed and the driving is finished and the start signal is applied to the electrophoretic display, the step for applying the reset compensation voltage to the step for applying the image display compensation voltage may be repeatedly executed.

Furthermore, different from the driving method according to an exemplary embodiment of the present invention, the reset image having the reversed polarity and the same multitude as may be applied to display an image of the fourth gray with white color, not black color, instead of the application of the reset voltage to each of the electrophoretic particles 323 and 326 disposed in each of the pixels PX1, PX2, PX3, PX4, and PX5 during the first time T1. In this case, various driving voltages having reversed polarity to and the same multitude as the driving voltages of the exemplary embodiment are substituted.

Figure 12:
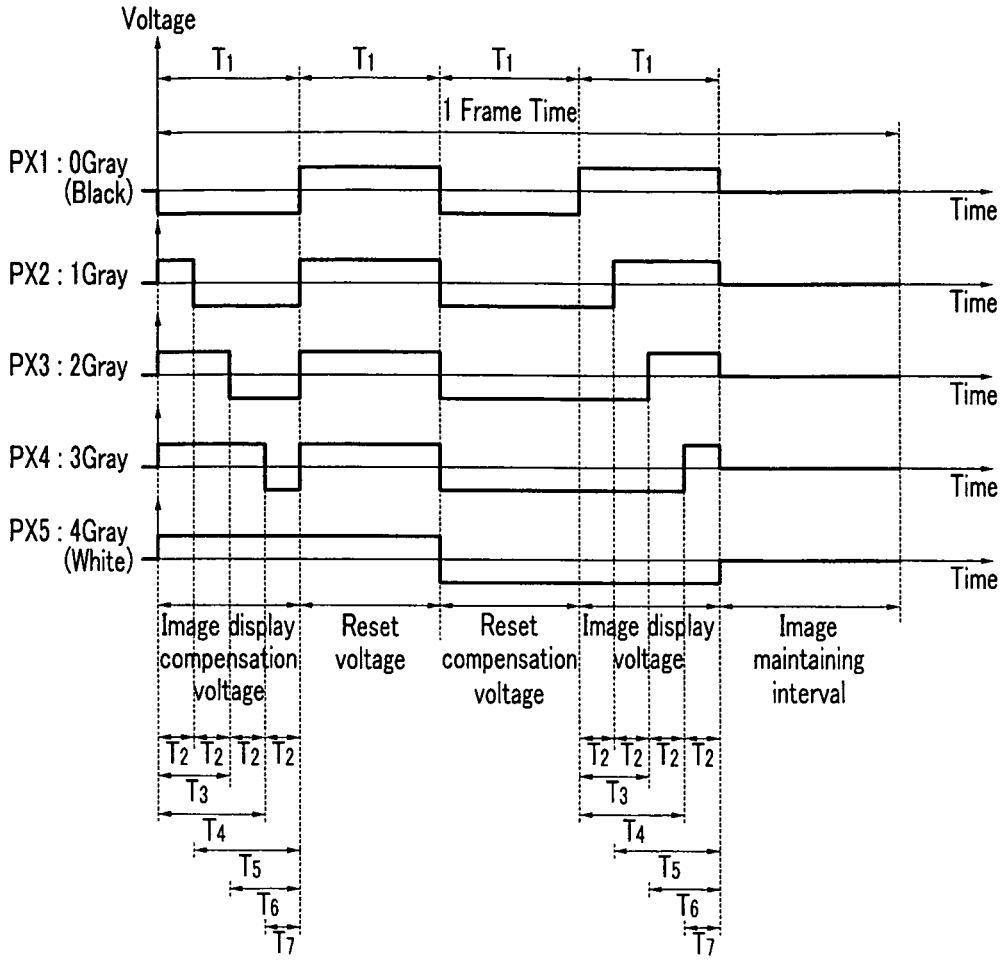
FIG. 12 is a timing diagram showing driving voltages applied to the electrophoretic particles disposed in the predetermined pixels per time to explain a method for driving an electrophoretic display according to a second exemplary embodiment of the present invention.

Described below is a driving method for driving an electrophoretic display according to a second exemplary embodiment of the present invention with reference to FIG. 12, with a focus on the differences from the method of driving the electrophoretic display according to the first exemplary embodiment of the present invention.

In the driving method of the electrophoretic display according to the second exemplary embodiment of the present invention, an image display compensation voltage is firstly applied to each pixel PX1, PX2, PX3, PX4, and PX5 before the application of a reset voltage. The subsequent voltage application steps are the same as those in the driving method of the electrophoretic display of the first embodiment of the present invention.

In this second embodiment, when a driving end signal is applied to the electrophoretic display in the step of applying the image display voltage, the driving may be finished after the completion of the step of applying the image display voltage. Next, when a driving start signal is applied to the electrophoretic display, the reset compensation voltage is applied after the step of applying the image display compensation voltage that is reversed with respect to the image display voltage that is applied before the driving end.

As above described, each pixel PX1, PX2, PX3, PX4, and PX5 displays the images of five grays from the 0 gray to the fourth gray that are different images in the driving method of the electrophoretic display according to the various exemplary embodiments of the present invention, but more various images of black and white may be displayed by subdividing the application time of the image display voltage and the image display compensation voltage.

Furthermore, the first electrophoretic particles 323 of the electrophoretic member 320 may have one of red, green, and blue colors instead of white for the electrophoretic display to display images of various colors. In this case, the first electrophoretic particles 323 having one of red, green, and blue colors are sequentially disposed in the pixel areas PX1, PX2, PX3, PX4, and PX5 along with the second electrophoretic particles 326 of black color. On the other hand, the first electrophoretic particles 323 may have one of yellow, magenta, or cyan instead of one of red, green, and blue.

While this invention has been described in connection with two exemplary embodiments, it is to be understood that the invention is not limited to the disclosed embodiments, but, on the contrary, covers various modifications and equivalent arrangements included within the spirit and scope of the appended claims.

As described above, according to the driving method of the electrophoretic display according to the exemplary embodiments of the present invention, the potential distribution is symmetrical in the boundary region between neighboring pixels such that the display size of real image of each of the pixels is uniform and an afterimage may be prevented, thereby improving the display performance.

What is claimed is:

1. A method for driving an electrophoretic display comprising a first electrode, a second electrode, and an electrophoretic layer provided between the first electrode and the second electrode, the electrophoretic layer comprising electrophoretic particles disposed in a plurality of pixels to receive a driving voltage from the first electrode and the second electrode, the method comprising:

applying to the pixels a reset voltage;

applying to the pixels a reset compensation voltage comprising a polarity opposite to a polarity of the reset voltage;

applying to the pixels an image display voltage during a first predetermined time period; and applying to the pixels during a second predetermined time period an image display compensation voltage comprising a polarity opposite to a polarity of the image display voltage, wherein the image display voltage corresponds to a predetermined gray level, wherein the value of the image display voltage integrated with corresponding application time of applying the image display voltage is substantially the same as the value of the image display compensation voltage integrated with corresponding application time of applying the image display compensation voltage, wherein the reset voltage, the reset compensation voltage, the image display voltage, and the image display compensation voltage are respectively applied for a first time length, wherein the reset voltage and the reset compensation voltage are the same multitude and the reversed polarity to each other, wherein the image display voltage includes a first sub-image display voltage comprising the same polarity and multitude as the reset voltage and a second sub-image display voltage comprising the same multitude and polarity as the reset compensation voltage, wherein the first sub-image display voltage is applied for the first time length to display a first color in the pixels, wherein the second sub-image display voltage is applied for a second time length, and then the first sub-image display voltage is applied for a fifth time length to display a second color in the pixels, wherein the second sub-image display voltage is applied for a third time length, and then the first sub-image display voltage is applied for a sixth time length to display a third color in the pixels, wherein the second sub-image display voltage is applied for a fourth time length, and then the first sub-image display voltage is applied for a seventh time length to display a fourth color in the pixels, wherein the second sub-image display voltage is applied for the first time length to display a fifth color in the pixels, wherein the image display compensation voltage includes a first sub-image display compensation voltage comprising the same multitude and polarity as the reset voltage and a second sub-image display compensation voltage comprising the same multitude and polarity as the reset compensation voltage, and wherein application time lengths of the first sub-image display compensation voltage and the second sub-image display compensation voltage respectively equal to application time lengths of the first sub-image display voltage and the second sub-image display voltage.

2. The method of claim 1, wherein a potential distribution comprising symmetry with respect to neighboring pixels among the plurality of pixels is formed by application of the image display voltage in boundary regions between the neighboring pixels.

3. The method of claim 1, further comprising:

maintaining an image displayed in each pixel for a third predetermined time between applying of the image display voltage and applying of the image display compensation voltage.

4. The method of claim 3, wherein a driving voltage comprising the same magnitude and the same polarity is applied to the first electrode and the second electrode, or the additional driving voltage is not applied in the step of maintaining the image.

5. The method of claim 1, wherein the image display compensation voltage is applied after applying the image display voltage.

6. The method of claim 5, wherein when a driving end signal is applied to the electrophoretic display in applying the image display voltage, the driving is finished after applying the image display compensation voltage.

7. The method of claim 5, wherein when a driving end signal is applied to the electrophoretic display in applying the image display voltage, the driving is finished after applying the image display voltage, but when a driving start signal is applied to the electrophoretic display, the image display compensation voltage is applied, and then the reset compensation voltage is applied.

8. The method of claim 1, wherein the image display compensation voltage is applied before applying the reset voltage.

9. The method of claim 8, wherein when a driving end signal is applied to the electrophoretic display in applying the image display voltage, the driving is finished after applying the image display voltage.

10. The method of claim 1, wherein the value of the reset voltage integrated with the corresponding application time is substantially the same as the value of the reset compensation voltage integrated with the corresponding application time.

11. The method of claim 1, wherein the first color is black, the fifth color is white, and luminance of color is gradually brighter from the first color to the fifth color.

12. The method of claim 1, wherein:

the second time length, the third time length, and the fourth time length are respectively ¼, ⅔, and ¾ of the first time length; and the fifth time length, the sixth time length, and the seventh time length are respectively ¾, ⅔, and ¼ of the first time length.

13. The method of claim 1, wherein the electrophoretic layer includes electrophoretic members comprising micro capsules enclosing a dielectric fluid in which the electrophoretic particles are disposed, and a fixing resin fixing the electrophoretic members, and at least a portion of the electrophoretic members are disposed between the neighboring pixels.

* * * * *